United States Patent [19]

Sedlacek et al.

[11] 4,059,331

[45] Nov. 22, 1977

[54] TERMINAL BLOCK

[75] Inventors: William S. Sedlacek, Chicago, Ill.; Louis Reffay, Igny, France

[73] Assignee: Reliable Electric Company, Franklin Park, Ill.

[21] Appl. No.: 659,796

[22] Filed: Feb. 20, 1976

[51] Int. Cl.[2] ..... H01R 9/06

[52] U.S. Cl. ..... 339/198 R; 29/764; 339/97 P

[58] Field of Search ..... 339/97 R, 97 P, 98, 339/99 R, 198 R, 198 G, 198 GA, 198 H, 198 S, 198 P; 179/98; 317/99, 122; 29/764

[56] References Cited

U.S. PATENT DOCUMENTS

| | | | |
|---|---|---|---|
| 3,631,378 | 12/1971 | Ellis | 339/198 GA |
| 3,760,331 | 9/1973 | Courley | 339/97 P |
| 3,899,237 | 8/1975 | Briggs | 339/198 R |

FOREIGN PATENT DOCUMENTS

| | | | |
|---|---|---|---|
| 2,048,143 | 4/1972 | Germany | 339/97 P |

*Primary Examiner*—Roy Lake
*Assistant Examiner*—Mark S. Bicks
*Attorney, Agent, or Firm*—Olson, Trexler, Wolters, Bushnell & Fosse, Ltd.

[57] ABSTRACT

A terminal block comprises clip type terminals which snap fit into the block and project outwardly from opposite faces of the block. The terminals are disposed in an array consisting of a number of rows and columns. At opposite margins of the terminal block are fanning strips for receiving the wires that are joined to the terminals. The block has recesses for the wires and the recesses are progressively deeper as they extend from the center of the block toward the fanning strips, thereby avoiding a buildup of conductors at the terminals that are adjacent to the fanning strips. The fanning strips also have resilient fingers that retain the wires in the various slots of the fanning strip.

7 Claims, 15 Drawing Figures

FIG. 9
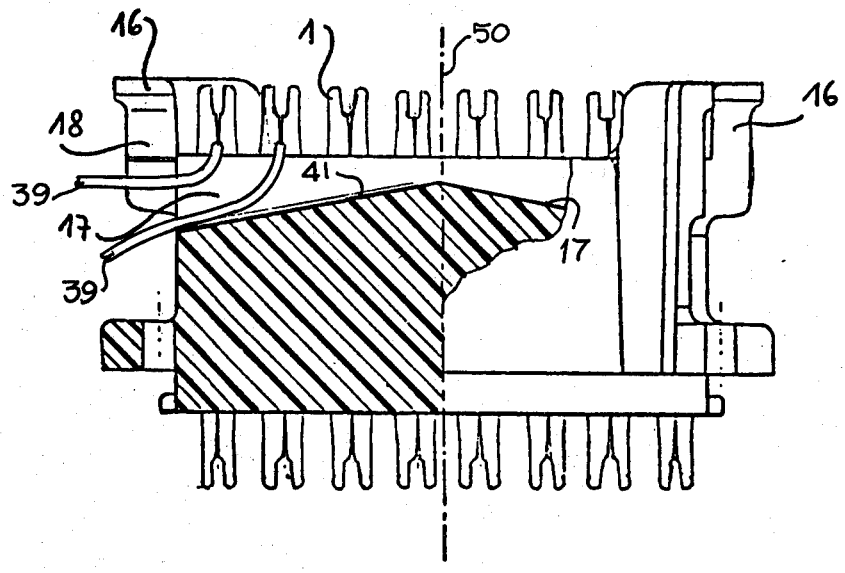
FIG. 10
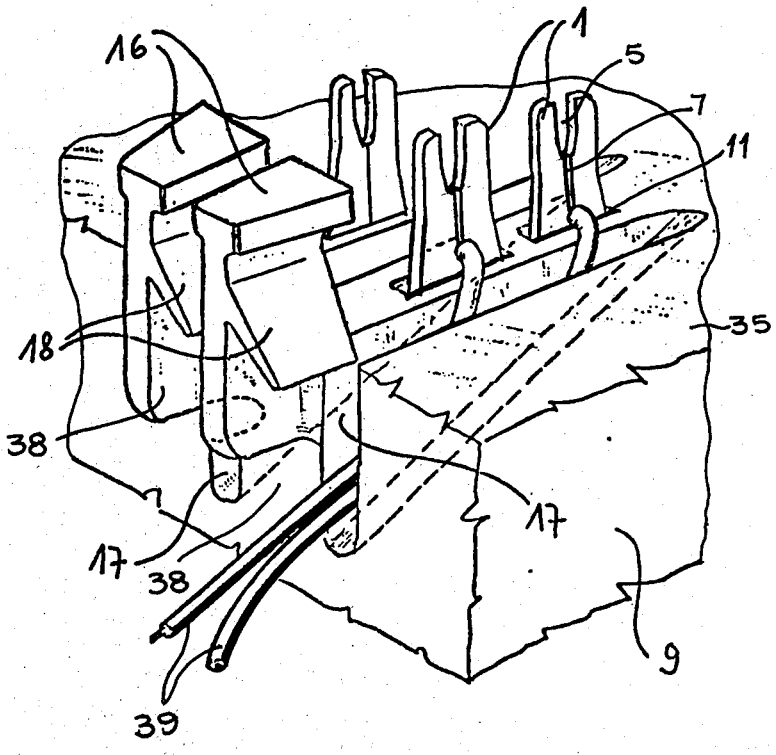
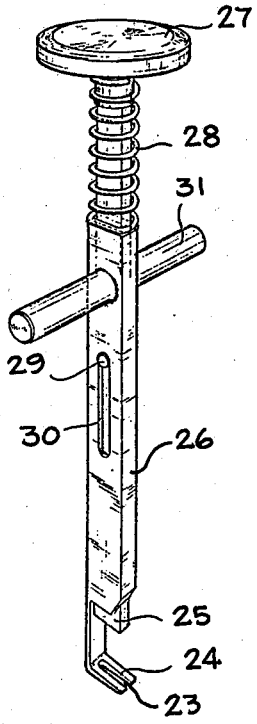
FIG. 11

TERMINAL BLOCK

BACKGROUND OF THE INVENTION

The present invention is concerned with improvments in terminal blocks of the type commonly used for connecting telephone and like communications circuits.

Terminal blocks of the foregoing type typically consist of a number of rows of terminals to provide a generally rectangular array of terminals projecting from opposite faces of the terminal block. Along opposed margins of the terminal block are fanning strips for receiving wires which are connected to the terminals. Generally, there is a buildup of conductor wires at the terminals that are adjacent to the fanning strips because the faces of the terminal block are not relieved or otherwise provided with sufficient space to accommodate all of the conductor wires. A buildup of wires along the face of the block adjacent to the terminals sometimes results in damage to the wires when a conductor is inserted into a nearby terminal using insertion tools of known types.

OBJECTS AND SUMMARY OF THE INVENTION

An object of the present invention is to provide a terminal block which precludes the buildup of conductors adjacent to the fanning strips.

A further object of this invention is to provide a terminal block which reduces the possibility of damage to connected conductors due to the buildup of conductors, as aforesaid.

A still further object of the present invention is to provide a terminal block which is uniquely shaped with recesses across its face to accommmodate the wires which pass through the fanning strips and are connected to the terminals.

Another object of this invention is to provide a terminal block in which the terminals are flat members of similar construction at their opposite ends and which can be snap fitted into the body of the block from one direction only, the snap-fitting arrangement preventing removal of the terminals once they have been mounted in place.

In accordance with the foregoing objects the terminal block comprises a body of dielectric material having a row of openings in at least one face of the body for receiving electrically conductive terminals to position of series of said terminals is spaced relation to each other. The block has a recess adjacent to said row of openings and running generally parallel thereto, said recess being exposed to said one face at each of said openings. A fanning strip is adjacent to an end of said recess and runs substantially at right angles to said row, said fanning strip having a series of slots at least one of which is presented to the recess. The recess has a depth, at least adjacent to said fanning strip, that is sufficient to accomodate a multiplicity of wires connected to the terminals and extending through said one slot in the fanning strip. There is a retaining finger forming part of the fanning strip and extending substantially across said one slot to retain the wires therein.

In the preferred from of the invention the depths of the aforesaid slots each progressively increase from the center portion of the terminal block body toward the fanning strip.

In one form of the invention the aforesaid slots are defined in part by ribs that have channels therebetween so as to form a generally hollow body for the block, the height of the ribs decreasing from the center portion of the body toward the fanning strip.

In another form of the invention the terminal block is defined in part by inclined surfaces extending from the center portion of the body toward the fanning strip.

Figure 6:
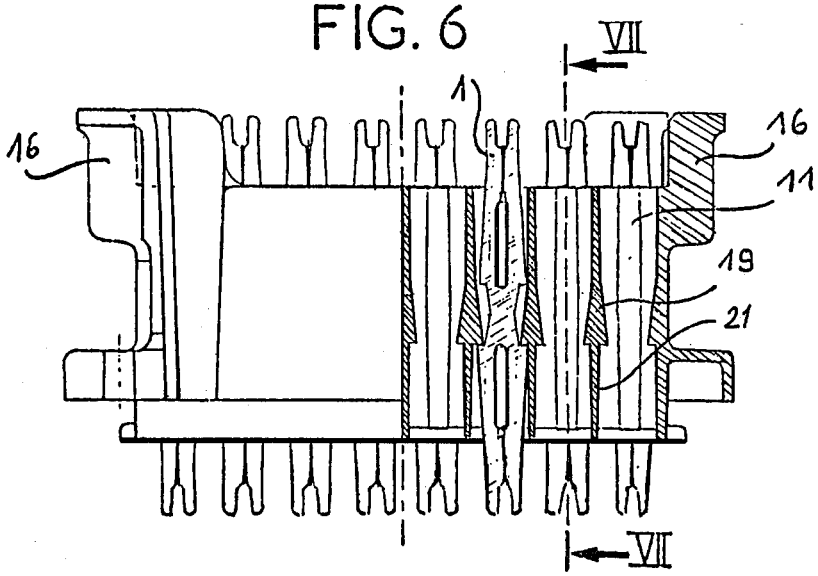
Figure 7A:
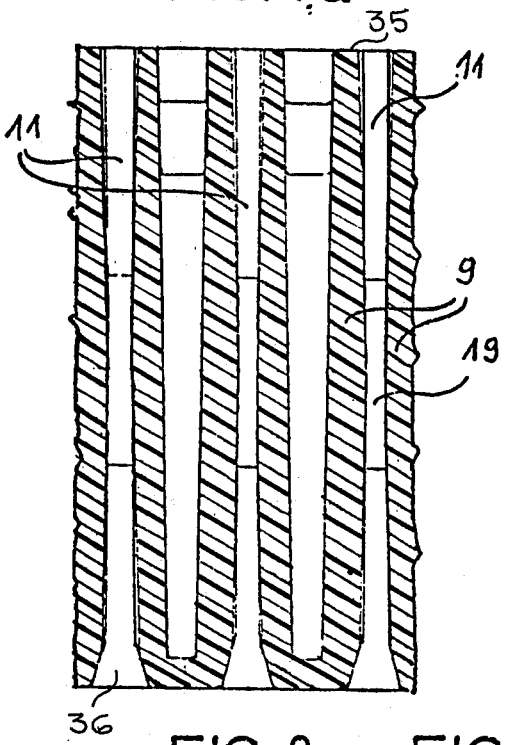
Figure 7B:
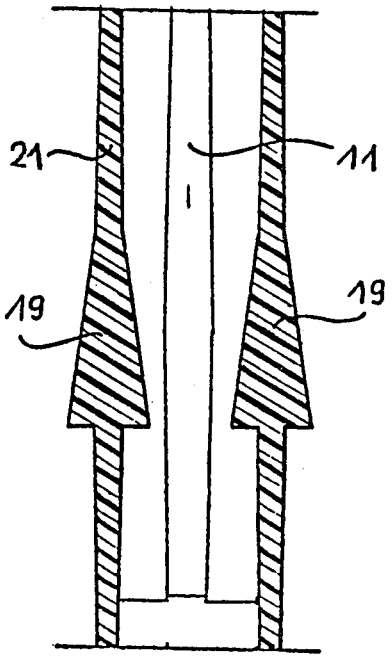

FIG. *7a* is a sectional view, on an enlarged scale taken approximately along line VII—VII of FIG. 6 but without showing the terminals;

FIG. *7b* is a longitudinal sectional view, on an enlarged scale, of a portion of FIG. 6;

FIG. *7c* is a fragmentary top plan view of the structure of FIG. *7b;*

FIG. *8a* is a fragmentary sectional view of a portion of FIG. *7b* and also showing a terminal of the present invention;

FIG. *8b* is a side elevational view of the terminal shown in FIG. *8a;*

FIG. *8c* is an enlargement of a portion of the upper end of the terminal of FIG. *8a;*

Figure 5:
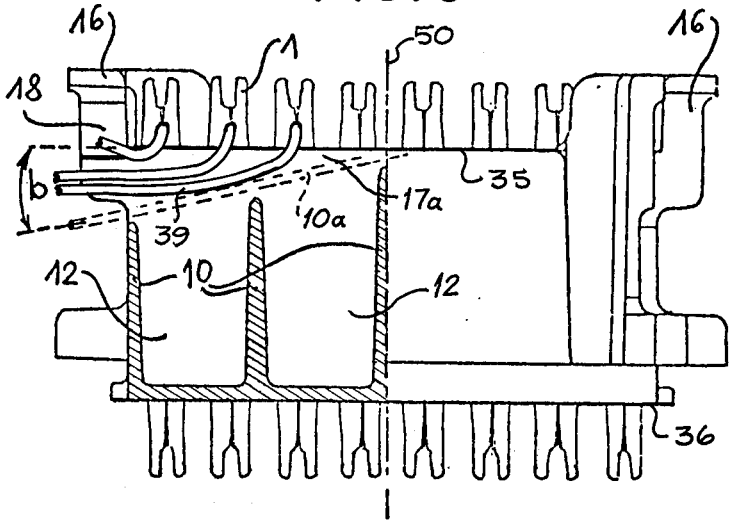
FIGS. 5 and 6 are partial sectional views taken along lines V—V and VI—VI respectively of FIG. 3.

FIG. 9 is a partial sectional view, similar to FIG. 5, but showing a modified form of the present invention;

FIG. 10 is a partial perspective view of the structure of FIG. 9; and

FIG. 11 is a perspective view of a tool for pulling the wires from the slots of the terminal.

DETAILED DESCRIPTION

Figure 1:
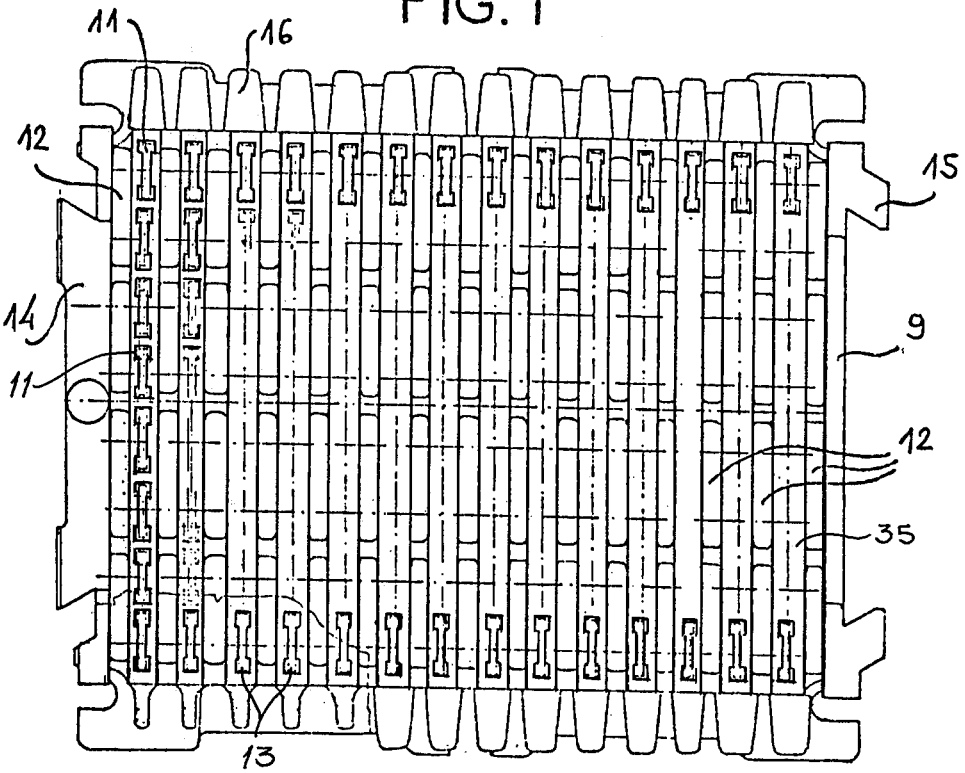
FIGS. 1 and 2 are top and bottom plan views of the connector block shown without the terminals therein.
Figure 2:
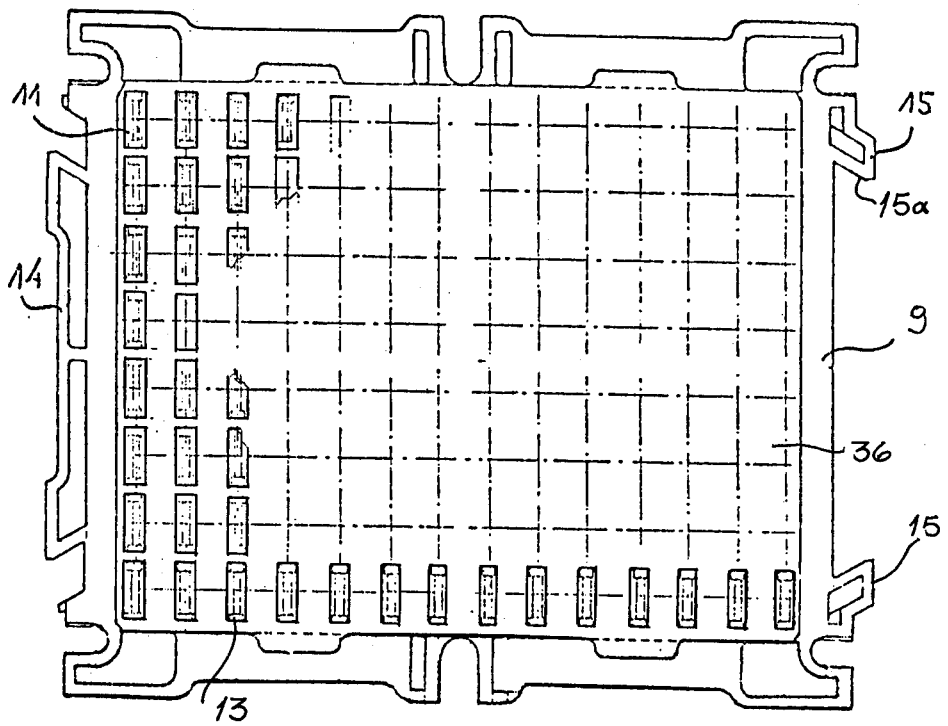
Figure 3:
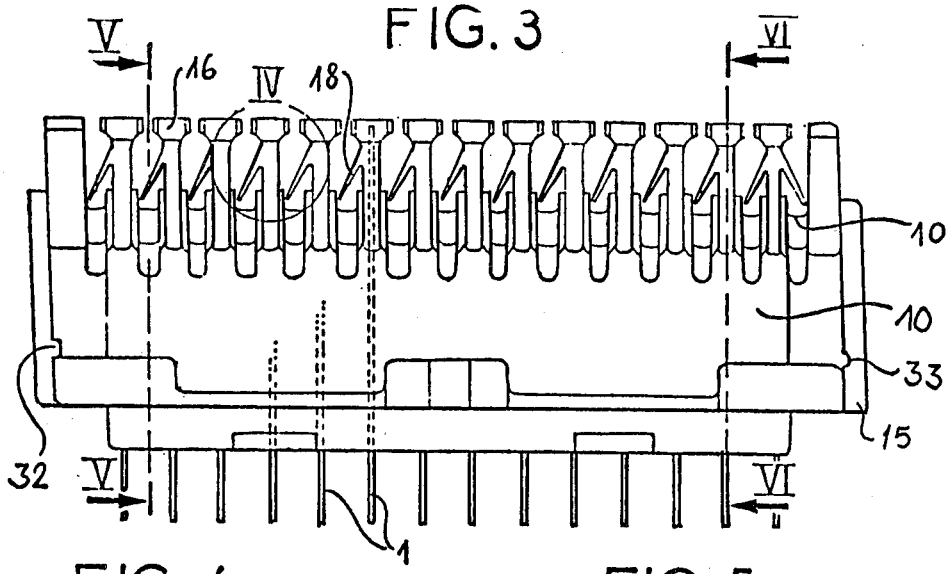
FIG. 3 is an end view of the terminal block and showing some of the terminals fragmentarily.

Referring now in more detail to the drawing there is shown a terminal block comprising a body 9 of dielectric plastic material such as thermoplastic or thermosetting resin, glass fiber reinforced resin, etc. The body has fanning strips 16,16 along opposite sides. As seen in FIGS. 1 and 2 one end of the body has angularly related lugs 15,15 that define a dovetail slot 15*a*. At the opposite end of the body there is a dovetail member 14 which is shaped to fit into a dovetail slot 15*a* on an adjacent terminal block whereby a number of terminal blocks may be connected together. The several connected-together terminal blocks may be retained by detents 33 (FIG. 3) and recesses 32 at respective opposite ends of the body 9. The detents 33 will come, of course, snap-fit into the recesses 32 of the adjacent block.

Formed in the body 9 and exposed to the opposite faces 35,36 there are a number of openings 11. The openings are disposed in rows 13 that are parallel and extend between the fanning strips 16,16 perpendicular thereto. The openings 11 in each row are aligned with the openings in the adjacent row so as to form a number of columns of openings 11 that extend between the opposite ends of the body 9, thereby resulting in the openings 11 being disposed in a rectangular array.

Mounted within the body 9 are terminals 1, each of which is formed of a flat piece of conductive material such as phosphor bronze. The terminal, which is adapted to receive a conductor 9, is made up of two opposing similar clip sections 2,2 that project from opposite faces 35,36 of the body. Each terminal section 2 has resilient arms 3,4. The resilient arms 3,4 define a notch 5 and an adjacent slot 7. The arms 3,4 also define an elongated opening 6 that extends from the base portion 23 of the section 2. The notch 5 is wider than the conductor 39 plus its insulation. The width of the slot 7 is substantially less than the width of the conductor 39. The width of the slot 7 is determined by a coining or stamping 8 that is immediately adjacent to the opening 6. This width may be about 0.3 to 0.8 mm. The smaller end of the notch 5 may be formed with 90° sharp corner edges, as is known in the art, to effect slicing of the insulation from a conductor 39 that is pushed from the notch 5 into the slot 7, as shown in FIGS. 5 and 10.

While the terminal 1 is shown to be symmetrical with respect to its opposite ends, the invention is not so limited. Thus, the terminal may have any suitable configuration for accepting a wire (e.g. wire wrap, etc.), but the present invention is suitable for a clip type section on at least the upper end, i.e. the end that projects from the face 35.

Figure 8A:
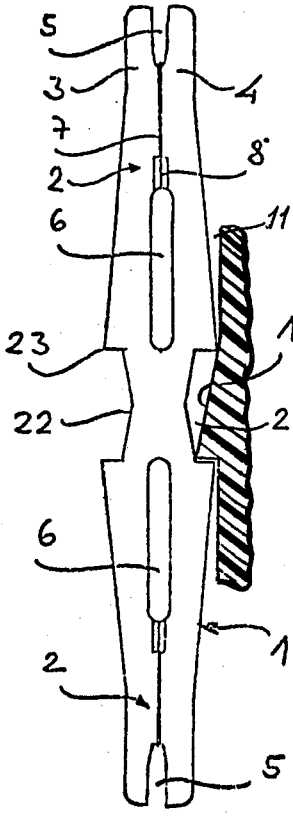
Figure 8B:
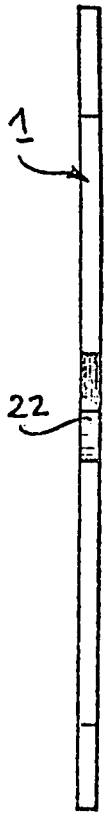
Figure 7C:
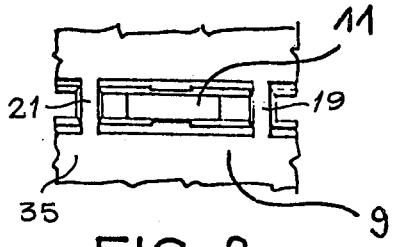
Figure 8C:
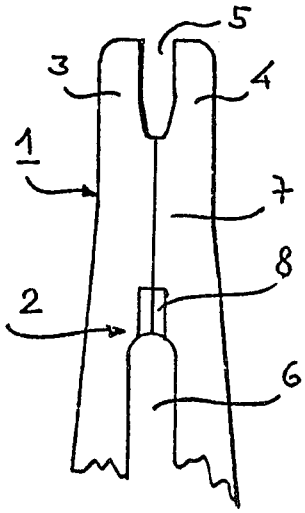

It will be seen that each terminal 1 is positioned in an opening 11 such that the terminals of any particular row 13 are in substantially the same plane. Means are also provided for interlocking each terminal 1 in its opening 11. As best seen in FIGS. 6–8*a* each terminal 1 has opposed cutouts or grooves 22,22 between the sections 2,2. These grooves 22 interlock with triangularly shaped projections 19,19 that are midway between opposite faces 35,36. The projections 19,19 are on the partitions 21 between the opening 11. Thus, as a terminal is inserted into an opening 11 from the top face 35, the body of the terminal or the material of the projection 19, or both, will yield so that the terminal snaps past the corner or shoulder of the projection 19 as seen in FIG. 8*a*. This prevents removal of the terminal from the block.

Formed in the body 9 of the block are recesses 17*a*, (FIG. 5) 17 (FIGS. 9 and 10) that are adjacent to each row 13 of the openings 11 and run generally parallel thereto. The recesses 17 or 17*a*, as the case may be, are exposed to the face 35 and are for the purpose of providing relief areas for insulated wires 39 that are connected to the terminals 1 and which project through the slots 38 in the fanning strips 16. By providing these relief areas it is possible to accommodate a large number of insulated wires 39 and avoid a crowding of those wires adjacent to the column of terminals that is next to the fanning strip. By avoiding this excessive buildup the possible damage to wires being inserted into the terminals by a suitable insertion tool is substantially reduced.

Figure 4:
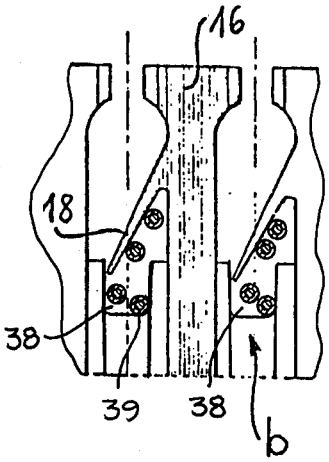
FIG. 4 is an enlargement of the encircled portion IV of FIG. 3.

In accordance with the preferred form of the invention the slot 17*a*(FIG. 5) or the slot 17 (FIGS. 9 and 10) is of progressively increasing depth from the centerline 50 of the body toward each fanning strip 16. In the structure of FIGS. 4 and 5, the body 9 is hollowed out to form a number of longitudinal ribs 10 that define channels 12 therebetween. The upper ends of the ribs 10 define a plane 10*a* (indicated by the broken lines in FIG. 5) whereby the recess 17*a* is of variable depth indicated by the angle *b*.

In FIGS. 9 and 10 the body 9 is of more solid construction. Therefore, the recess 17 is defined in part by an inclined surface 41 that extends from the centerline 50 of the body toward the respective fanning strips 16,16.

The conductor wires 39 are maintained in the fanning strips slots 38 by resilient fingers 18, one associated with each slot 38, and which angle downwardly toward the lower face 36. These fingers 18 allow the wires 39 to snap therepast and still provide a substantial region in the slots 38 for the conductors occupy above the free ends of the fingers 18.

FIG. 11 shows a tool that permits extraction of the wires 39 from the bottom of the slot 7. This tool includes a foot 24 having a recess 23 therein for receiving the body of the terminal. The tool further comprises a piston or plunger 25 movable in a tube 26 under the action of a handle 27. A recoil spring 28 encircles the upper end of the piston 25 and biases the piston to its "up" position. This "up" position is limited by a cross pin 29 that is positioned on the piston and rides in a slot 30 in the tube 26. The handle 31 assures a firm finger grip of the tool.

Extraction of a wire from the slot 7 is effected by placing the foot 24 under the conductor wire and supporting the lower end of the piston 25 on the upper end of the terminal. As the handle 27 is depressed the foot 23 rises, thereby pulling the wire 39 out of the slot 17.

The invention is claimed as follows:

1. A terminal block comprising a body of dielectric material having top and lower faces and a row of openings in at least one of said faces for receiving electrically conductive terminals to position a series of said terminals in spaced relation to each other, said block having a recess adjacent to said row of openings and running generally parallel thereto, said recess being exposed to said top face at each of said openings, a fanning strip adjacent to said top face and an end of said recess and running substantially at right angles to said row, said fanning strip having a series of slots at least one of which is presented to said recess, said recess having a depth, at least adjacent to said fanning strip, sufficient to accommodate a multiplicity of wires connected to the terminals and extending through said one slot in the fanning strip, and a retaining finger forming part of said fanning strip and extending substantially across said one slot to retain said wires therein, said finger being resilient and angling toward said lower face so as to allow wires in said one slot to snap past the free end of said finger when the wires are moved toward said lower face, the angularity of said finger providing a substantial region in said one slot above said free end for accommodation of said wires.

2. A terminal block according to claim 1 in which the depth of said recess progressively increases from the center portion of the body toward said fanning strip.

3. A terminal block according to claim 2 in which said recess is defined in part by ribs that have channels therebetween, the height of the ribs decreasing from said center portion toward said fanning strip.

4. A terminal block according to claim 2 in which said recess is defined in part by an inclined surface extending from the center portion of the body toward said fanning strip.

5. A terminal block according to claim 1 including clip type terminals having means cooperating with detents in the body at said openings for snap fitting retention of the edges of the terminals in said body.

6. A terminal block according to claim 1 including a number of said rows of openings each with terminals therein projecting from opposite faces of the body.

7. A terminal block according to claim 6 in which there are a number of said recesses, one adjacent to each row.

* * * * *